US008562079B2

(12) United States Patent
Wang

(10) Patent No.: US 8,562,079 B2
(45) Date of Patent: Oct. 22, 2013

(54) ROAD PLANING TOOL

(76) Inventor: Mu-Yi Wang, Taichung (TW)

( * ) Notice: Subject to any disclaimer, the term of this patent is extended or adjusted under 35 U.S.C. 154(b) by 47 days.

(21) Appl. No.: 13/377,482

(22) PCT Filed: Jun. 7, 2010

(86) PCT No.: PCT/CN2010/073600
§ 371 (c)(1),
(2), (4) Date: Dec. 9, 2011

(87) PCT Pub. No.: WO2010/142224
PCT Pub. Date: Dec. 16, 2010

(65) Prior Publication Data

US 2012/0080931 A1 Apr. 5, 2012

(30) Foreign Application Priority Data

Jun. 10, 2009 (CN) ..... 2009 2 0149730 U

(51) Int. Cl.
*E21C 35/183* (2006.01)

(52) U.S. Cl.
USPC ..... 299/113; 299/111

(58) Field of Classification Search
USPC ..... 299/111, 101, 113
See application file for complete search history.

(56) References Cited

U.S. PATENT DOCUMENTS

| | | | | |
|---|---|---|---|---|
| 4,302,053 | A | 11/1981 | Roepke | |
| 8,215,420 | B2 * | 7/2012 | Hall et al. | 175/433 |
| 2009/0051212 | A1 * | 2/2009 | Monyak et al. | 299/111 |
| 2009/0058174 | A1 * | 3/2009 | Hall et al. | 299/111 |
| 2009/0256413 | A1 * | 10/2009 | Majagi et al. | 299/100 |

FOREIGN PATENT DOCUMENTS

| | | | |
|---|---|---|---|
| CN | 2501646 | Y | 7/2002 |
| CN | 2816113 | Y | 9/2006 |
| CN | 2918521 | Y | 7/2007 |
| CN | 201424622 | Y | 3/2010 |
| EP | 0142124 | A2 | 5/1985 |
| FR | 2259678 | | 8/1975 |

* cited by examiner

*Primary Examiner* — David Bagnell
*Assistant Examiner* — Michael Goodwin
(74) *Attorney, Agent, or Firm* — Muncy, Geissler, Olds & Lowe, PLLC

(57) ABSTRACT

A road planing tool includes a tool holder having a front end thereof formed with an assembling socket, and a tool bit being in a cone-like shape and having a tip and a bottom, wherein the bottom is configured to be fittingly inlaid in the assembling socket. The road planing tool is characterized in that: the bottom of the tool bit has a plurality of projecting retaining teeth, and the assembling socket is peripherally formed with a toothed inner rim correspondingly, wherein fittingly engagement between the retaining teeth and the toothed inner rim allows the tool bit to be firmly combined with the tool holder.

3 Claims, 7 Drawing Sheets

ROAD PLANING TOOL

BACKGROUND OF THE INVENTION

1. Technical Field

The present invention relates to tools for road construction, and more particularly to a road planing tool, which has its tool holder and replaceable tool bit combined by means of a joint mechanism for strengthening combination between the tool bit and the tool holder.

2. Description of Related Art

As shown in FIG. 1 and FIG. 2, an existing road planing tool comprises a tool holder 1 having an assembling socket 2. The assembling socket 2 is a round recess for receiving a generally cone-like tool bit 3 that is typically made of a hardened material such as tungsten steel. After the tool bit 3 is inlaid into the assembling socket 2, weld is applied to fixedly combine the tool bit 3 with the tool holder 1.

In road planing operation, the tool bit 3 of the road planing tool contacts the road surface for scraping off the asphalt road surface. Generally, such road planing tools are consumables, and would have the tool bit 3 worn out within two days under normal use, and even within 10 hours under heavy workload. Therefore, only the tool bit 3 is made of costly hardened material, and the tool holder is made of normal steel.

In the existing technology, there is no special combining structure between the tool bit 3 and the tool holder 1. Merely weld is applied to the boundary between the bottom of the tool bit 3 and the assembling socket 2. However, since the pressure is focused on the tool bit 3 during road planing operation, if the weld implemented is defective, the tool bit 3 is likely to come off the tool holder 1. A road planing machine typically has more than one hundred tools. In the event that the tool bit 3 escapes during road planing operation, the operation has to be broken off for replacing the tool, thus causing waste of time. In addition, once the tool bit 3 escapes, the tool is unusable, so the service life of the tool is significantly shortened and this increases costs.

SUMMARY OF THE INVENTION

One objective of the present invention is to provide a road planing tool having its tool holder and tool bit firmly combined, so as to prevent the tool bit from accidentally escaping.

For the above objective, the present invention provides a road planing tool, which comprises:

a tool holder having a front end thereof formed with an assembling socket; and a tool bit being in a cone-like shape and having a tip and a bottom, wherein the bottom is configured to be fittingly inlaid in the assembling socket.

The road planing tool is characterized in that: the bottom of the tool bit has a plurality of projecting retaining teeth, and the assembling socket is peripherally formed with a toothed inner rim correspondingly, wherein fittingly engagement between the retaining teeth and the toothed inner rim allows the tool bit to be firmly combined with the tool holder.

The road planing tool of the present invention provides the following effects:

In the present invention, the tool holder and the tool bit are combined by an innovative toothed structure instead of the plane structure as used in the prior art. When the bottom of the tool bit is installed into the assembling socket, the toothed inner rim and the retaining teeth engage mutually, thereby ensuring that the tool bit is firmly positioned in the assembling socket.

Since the length of the boundary between the toothed inner rim and the retaining teeth is longer than the traditional design, the coverage of the resultant welding pass is lengthened and the welding strength is improved as compared with the prior art.

In addition, each of the retaining teeth has a tooth top at its top and has a tooth base at its bottom, wherein the tooth top is wider than the tooth base. When the tool bit bears load, the mutually engaged toothed inner rim and retaining teeth can effectively resist external force, thereby preventing the tool bit from coming off the tool holder.

DETAILED DESCRIPTION OF THE INVENTION

The invention as well as a preferred mode of use, further objectives and advantages thereof will be best understood by reference to the following detailed description of illustrative embodiments when read in conjunction with the accompanying drawings.

Figure 1:
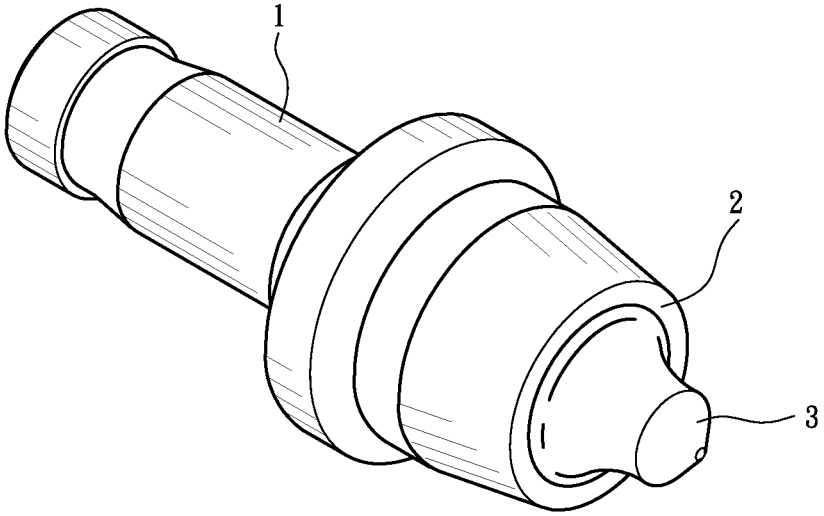
FIG. 1 PRIOR ART
FIG. 1 is a perspective view of an existing road planing tool.
Figure 2:
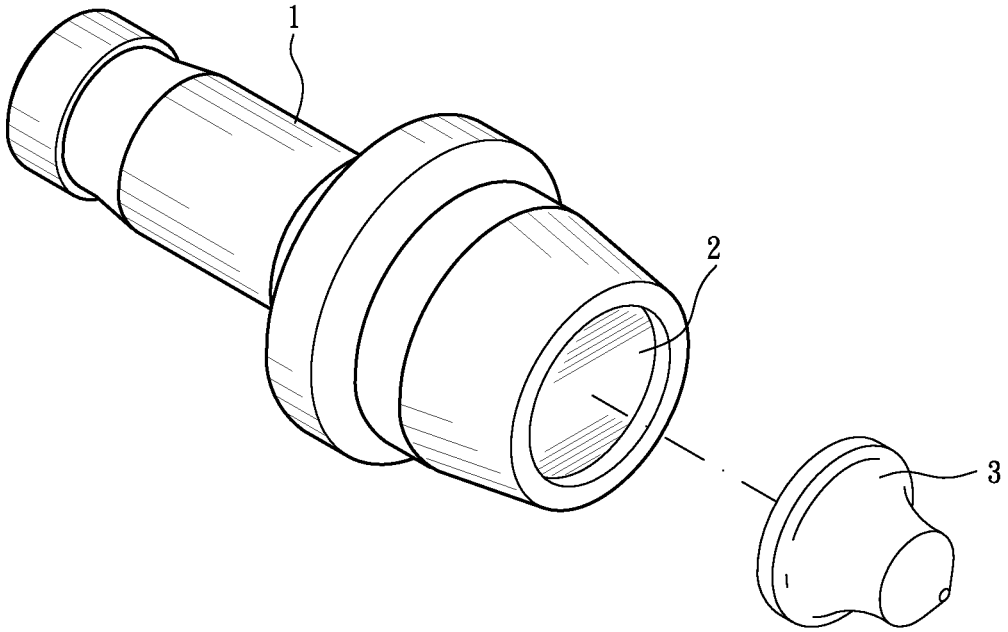
FIG. 2 PRIOR ART
FIG. 2 is an exploded view of the existing road planing tool of FIG. 1.
Figure 3:
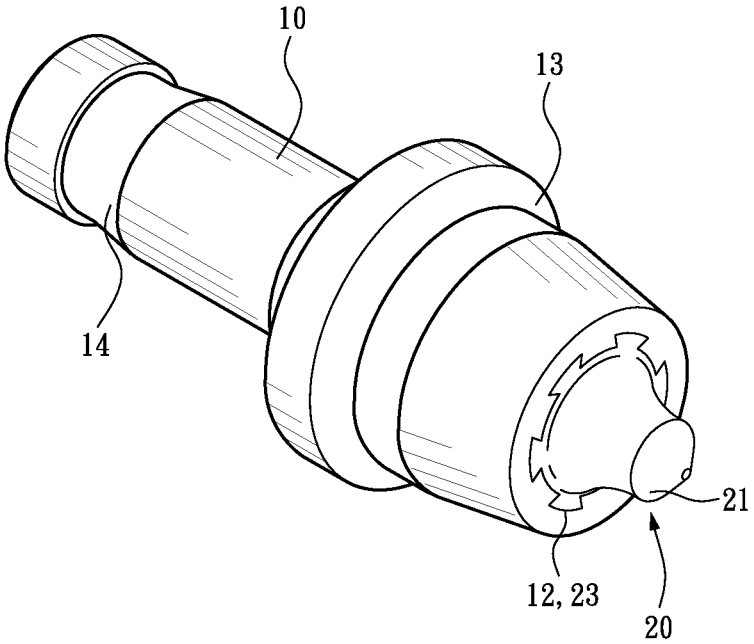
FIG. 3 is a perspective view of a road planing tool according to the present invention.
Figure 4:
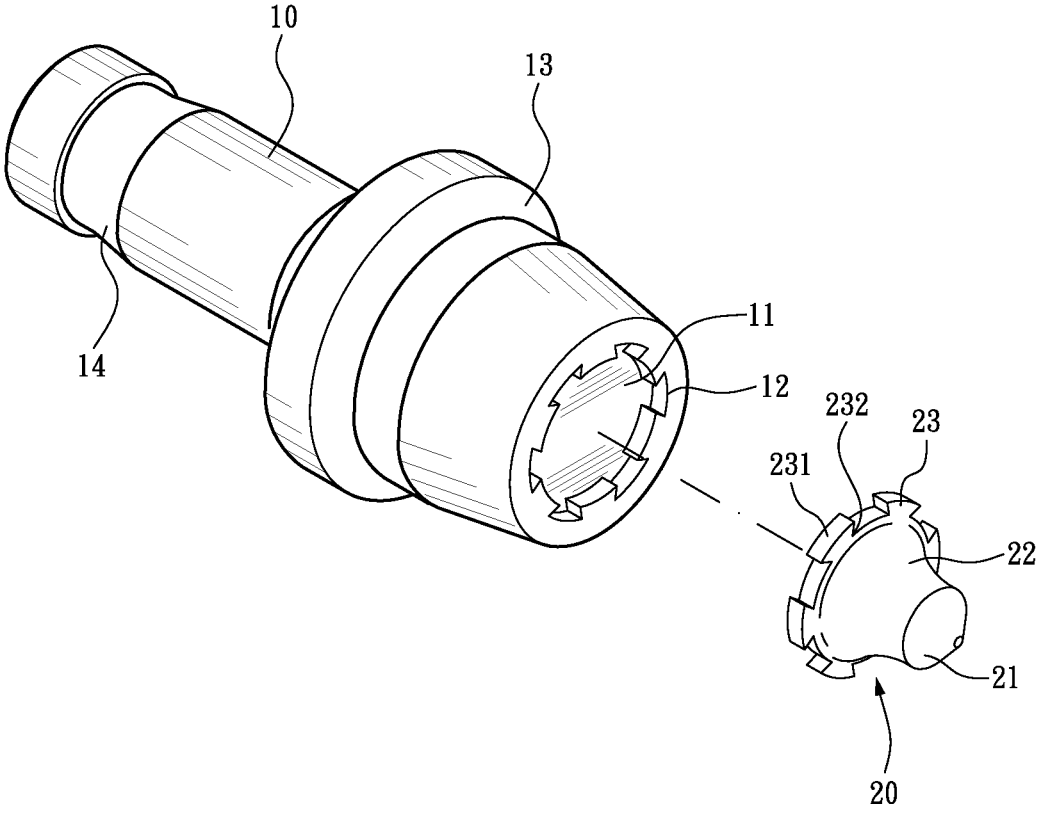
FIG. 4 is an exploded view of the road planing tool according to the present invention.

As shown in FIG. 3 and FIG. 4, a road planing tool comprises a tool holder 10 and a tool bit 20.

The tool holder 10 has its front end formed with an assembling socket 11.

The tool bit 20 is generally in a cone-like shape, and has a tip 21 and a bottom 22. The bottom 22 is configured to be fittingly inlaid into the assembling socket 11.

Therein, the bottom 22 of the tool bit 20 is provided with a plurality of projecting retaining teeth 23. Each of the retaining teeth 23 has a tooth top 231 at its top and has a tooth base 232 at its bottom. The tooth top 231 is larger than the tooth base 232 in width. In addition, the assembling socket 11 is peripherally provided with a toothed inner rim 12 meeting the retaining teeth 23 in shape so that the retaining teeth 23 can be fittingly received in the toothed inner rim 12.

Based on the configuration as described above, the operation of the present invention will be explained in detail below.

Figure 5:
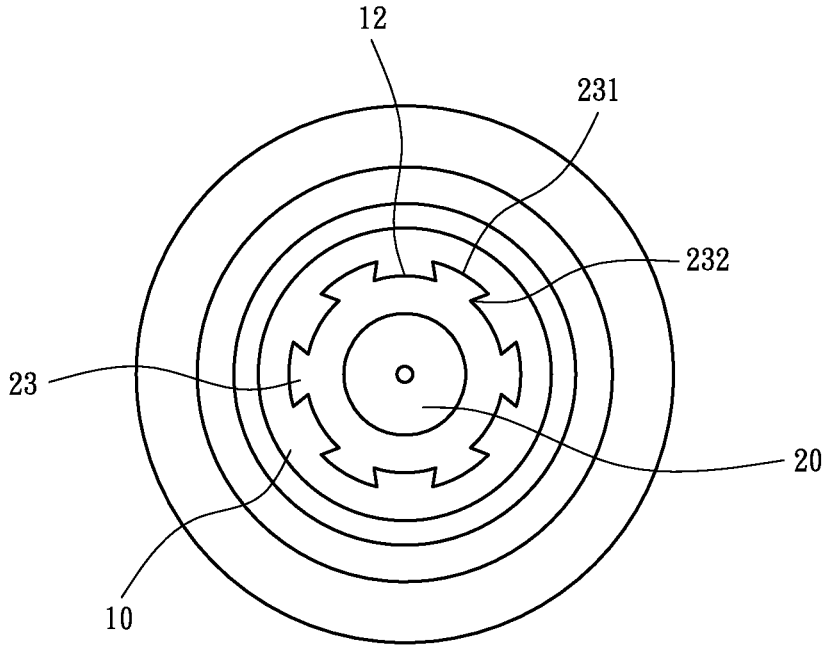
FIG. 5 is a schematic drawing illustrating combination of the tool bit and the tool holder according to the present invention.
Figure 6:
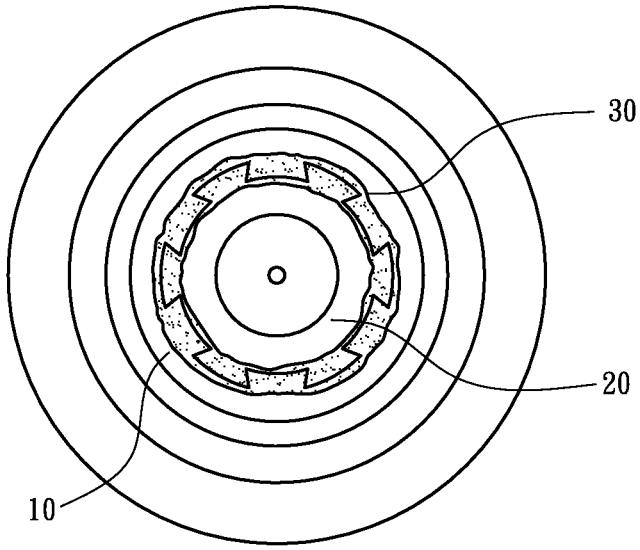
FIG. 6 is a schematic drawing illustrating the welding pass applied to the tool bit according to the present invention.

As shown in FIG. 5, in virtue of the retaining teeth 23 of the tool bit 20, when the bottom 22 of the tool bit 20 is installed in the assembling socket 11, the toothed inner rim 12 and the retaining teeth 23 engage mutually, so that the tool bit 20 is firmly positioned within the assembling socket 11. Referring to FIG. 6, weld may be applied to the boundary between the toothed inner rim 12 and the retaining teeth 23 to make both fully combined. Since the length of the boundary between the toothed inner rim 12 and the retaining teeth 23 is longer than the traditional design, the coverage of the resultant welding pass 30 is lengthened and the welding strength is improved as compared with the prior art.

In road planing operation, the tool bit 20 of the road planing tool contacts the road surface angularly, so the pressure applied to the tool bit 20 is focused on the tip 21 and its lateral. In the present invention, the tool holder 10 and the tool bit 20 are combined by an innovative toothed structure instead of the plane structure as used in the prior art, and the tooth top 231 of the retaining teeth 23 is wider than the tooth base 232. When the tool bit 20 bears load, the mutually engaged toothed inner rim 12 and retaining teeth 23 can effectively resist external force, thereby preventing the tool bit 20 from coming off the tool holder 10.

Figure 7:
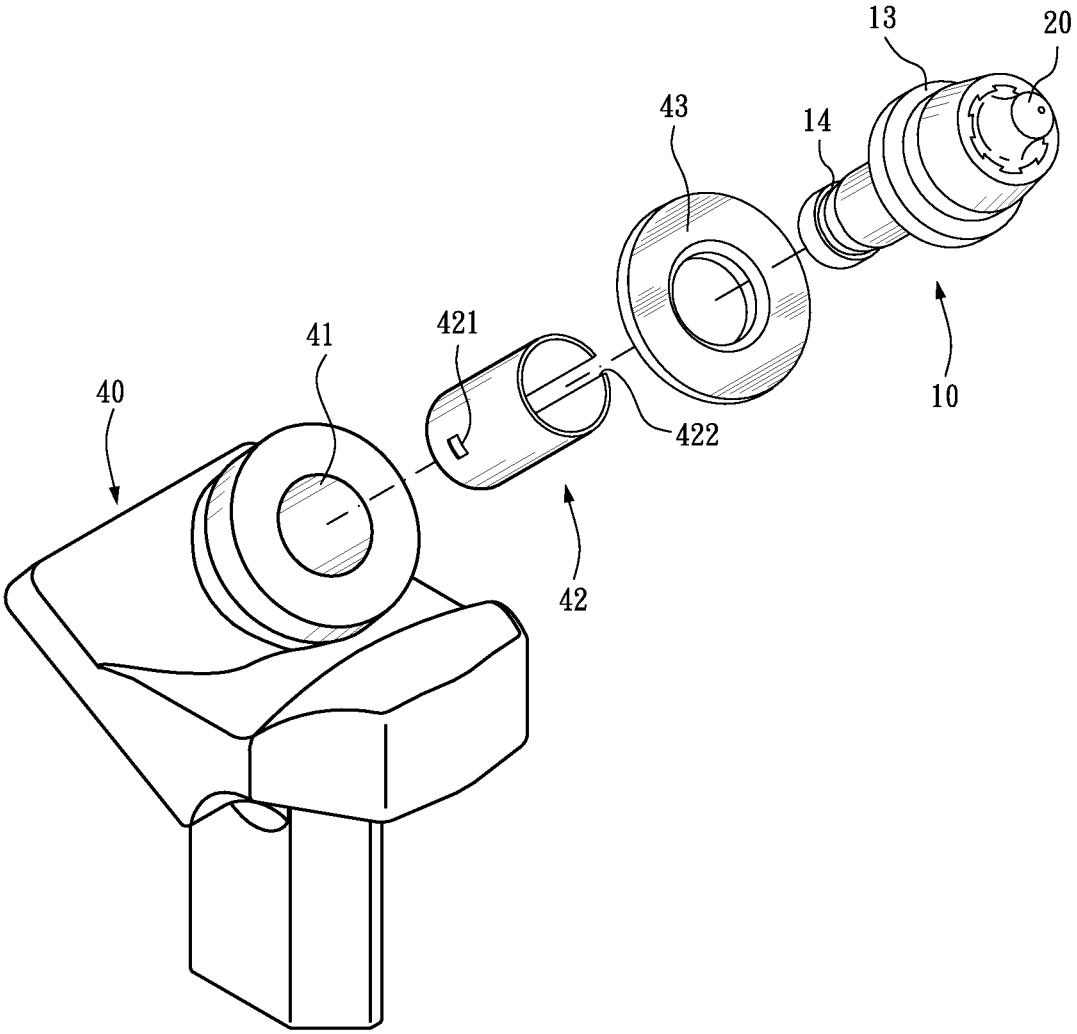
FIG. 7 is an exploded view of the tool of the present invention assembled to a tool base.

Furthermore, as shown in FIG. 7, the tool holder 10 has its front end formed as a diametrically enlarged head 13, and has its columnar body formed with an annular groove 14. The road planing tool further has a tool base 40. The tool base 40 has an axial hole 41 passing therethrough. The axial hole 41 fittingly receives a sleeve 42. The sleeve 42 has its inner wall provided with an inward raised retaining point 421 corresponding to the annular groove 14 and has its lateral formed with a gap 422, so that the sleeve 42 is expandable in the radial direction. A spacer 43 is mounted around the body of the tool holder 10 and abuts against the head 13.

Figure 8:
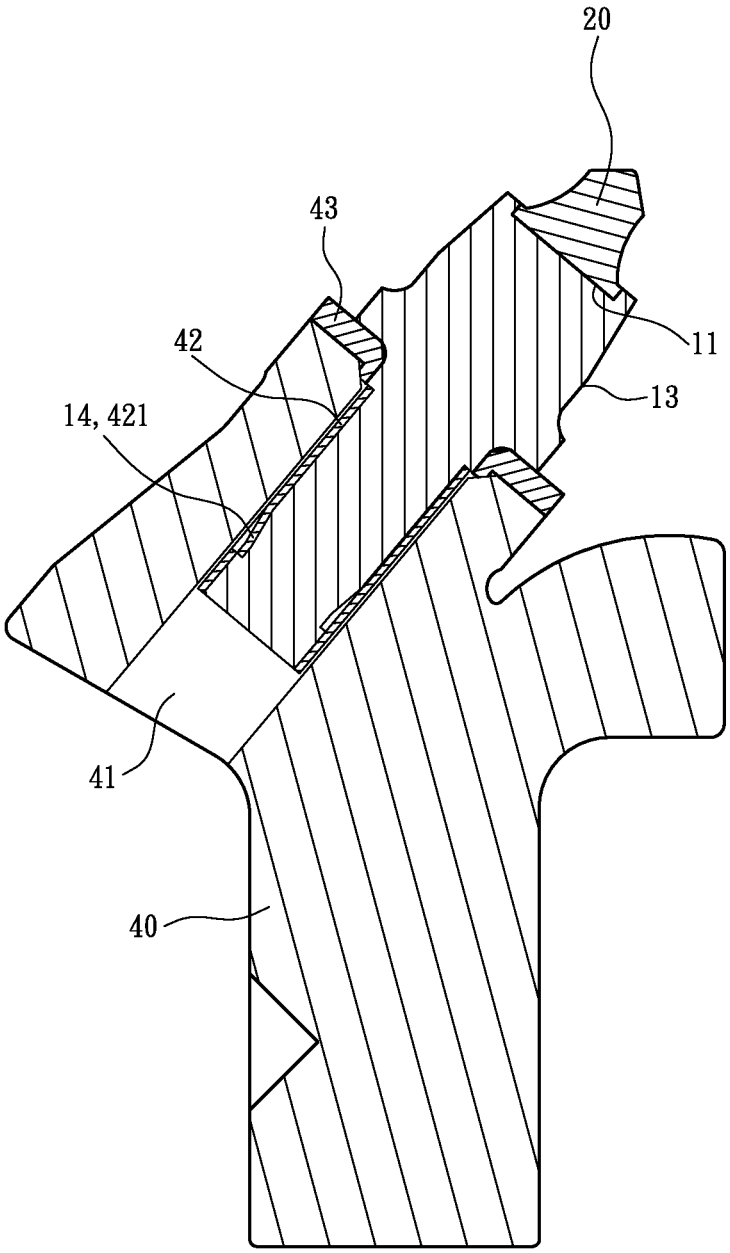
FIG. 8 is a cross-sectional view of the tool of the present invention assembled to a tool base.

As shown in FIG. 8, the inner diameter of the sleeve 42 is approximately equal to the body of the tool holder 10. In the course of installing the body of the tool holder 10 into the sleeve 42, the sleeve 42, in virtue of the gap 422, can expand to allow the retaining point 421 to smoothly slide into the annular groove 14. The retaining point 421 of the sleeve 42 thereby axially positions the sleeve 42 with respect to the tool holder 10.

Then the tool holder 10 and the sleeve 42 are placed into the axial hole 41. The expandable nature of the sleeve 42 allows the sleeve 42 to be fittingly positioned in the axial hole 41, and the retaining point 421 of the sleeve 42 allows the tool holder 10 to be positioned in the axial hole 41 and the sleeve 42.

While the retaining point 421 retains the tool holder 10 inside the axial hole 41, the tool holder 10 is allowed to rotate within the axial hole 41 during the road planing operation, so as to ensure the tool bit 20 being equally worn along its periphery, thereby lengthening the service life of the tool.

When the tool bit 20 is worn out, the replacement can be achieved by extracting the tool holder 10 and the sleeve 42 out of the axial hole 41, and installing a spare tool.

The present invention has been described with reference to the preferred embodiment and it is understood that the embodiment is not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A road planing tool, comprising:

a tool holder having a front end thereof formed with an assembling socket; and a tool bit being in a cone-like shape and having a tip and a bottom, wherein the bottom is configured to be fittingly inlaid in the assembling socket;

the road planing tool being characterized in that: the bottom of the tool bit has a plurality of radially projecting retaining teeth, and the assembling socket is peripherally and radially formed with a concavely and convexly toothed inner rim correspondingly, wherein fitting engagement between the retaining teeth and the toothed inner rim allows the tool bit to be firmly combined with the tool holder.

2. The road planing tool of claim 1, being characterized in that: each of said retaining teeth has a tooth top at a top thereof and a tooth base at a bottom thereof, wherein the tooth top has a width larger than a width of the tooth base.

3. The road planing tool of claim 1, being characterized in that: a welding pass is provided along a boundary between the retaining teeth and the toothed inner rim, for strengthening combination between the tool bit and the tool holder.

* * * * *